US006663434B1

(12) United States Patent
Wu

(10) Patent No.: US 6,663,434 B1
(45) Date of Patent: Dec. 16, 2003

(54) EXTENDER FOR INTERCONNECTING MALE CONNECTOR AND FEMALE CONNECTOR

(75) Inventor: Jery Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/206,289

(22) Filed: Jul. 26, 2002

(51) Int. Cl.[7] ..... H01R 25/00
(52) U.S. Cl. ..... 439/638; 439/350; 439/677
(58) Field of Search ..... 439/638, 660, 439/680, 353, 357, 358, 365, 350, 677

(56) References Cited

U.S. PATENT DOCUMENTS 6,071,150 A 6/2000 Tang et al.
6,123,582 A * 9/2000 Ko et al. ..... 439/579
6,186,832 B1 * 2/2001 Madden et al. ..... 439/638
6,315,616 B1 * 11/2001 Hayashi ..... 439/638
6,331,122 B1 12/2001 Wu
6,379,189 B2 * 4/2002 Sakai et al. ..... 439/651
6,483,709 B1 * 11/2002 Layton ..... 361/724

OTHER PUBLICATIONS

Serial ATA: High Speed Serialized AT Attachment Revision 1.0 Aug. 29, 2001 p. 39 http://www.serialata.org/cgi–bin/SpecDownload.cgi.

* cited by examiner

*Primary Examiner*—Hien Vu
(74) *Attorney, Agent, or Firm*—Wei Te Chung

(57) ABSTRACT

An extender (10) includes a female portion (12) and a male portion (14) adapted to be back-to-back assembled. The female portion comprises a first housing (16) defining two slots (28) and a plurality of first contacts (18, 19). A plurality of first passageways (30) is defined in the first housing and communicates with the slots. The first contacts are retained into the first passageways. The male portion comprises a second housing (40) having a pair of tongues (46) and a plurality of second contacts (41). The tongues define a plurality of positioning slits (52, 53) for receiving the second contacts. Each of the first contacts is aligned and cooperated with a corresponding second contact to form a transmission path. Two pairs of latch devices (35, 60) are provided on opposite ends of the female portion and male potion for fastening each other.

9 Claims, 7 Drawing Sheets

EXTENDER FOR INTERCONNECTING MALE CONNECTOR AND FEMALE CONNECTOR

BACKGROUND OF THE INVENTION

1. Field of the Invention

The present invention relates to an electrical device for use within a computer, and particularly to an electrical extender having two opposite connection ports adapted to be respectively coupled to a connector mounted on a backplane and a connector mounted on a hard drive for cooperatively electrically connecting the hard drive to the backplane.

2. Description of Related Art

An organization, known as a Serial Advanced Technology Attachment (Serial ATA) Working Group, releases a specification to define the Serial ATA interface and the corresponding connectors. This interface is used to connect storage devices such as hard disk, DVD, and CD-RW drives to the-PC motherboard. The specification defines a male and a female electrical connectors respectively connected to the storage device and mounted on a backplane. Such connectors can be referred to the specification released by the Serial ATA Working Group on Aug. 29, 2001, entitled "Serial ATA: High Speed Serialized AT Attachment", which is submitted herewith by Information Disclosure Statement (IDS). U.S. Pat. No. 6,331,122 also discloses a female Serial ATA connector.

Generally, a female Serial ATA connector is mounted on a backplane in the computer and a male Serial ATA connector is mounted to a hard disk which is intended to be attached to the backplane for establishing signal transmission between the hard disk and the backplane through the interconnection of such female and male connectors. Ideally, the relative positions of the backplane and the hard drive should be precisely arranged so that the hard drive can be properly and correctly connected to the backplane through such pair of male and female connectors. However, it is difficult for un-mated male Serial ATA connector of the hard drive and female Serial ATA connector of the backplane to reach their final predetermined secured positions. Accordingly, an extender interconnecting the Serial ATA male and female connectors is desired for compensation.

Hence, an extender interconnecting the male and female connectors is desired to overcome the above-mentioned disadvantages.

SUMMARY OF THE INVENTION

Accordingly, an object of the present invention is to provide an extender adapted to mate a male Serial ATA connector and a female Serial ATA connector, respectively, on two opposite sides thereof, so as to accomplish the electrical connection between a hard drive and a backplane through the extender.

In order to achieve the object set forth, an extender in accordance with the present invention includes a female portion and a male portion adapted to be back-to-back assembled. The female portion comprises a first housing defining two slots and a plurality of first contacts. A plurality of first passageways is defined in the first housing and communicates with the slots. The first contacts are retained in the first passageways. The male portion comprises a second housing having a pair of tongues and a plurality of second contacts. The tongues define a plurality of positioning slits for receiving the second contacts. Each of the first contacts is aligned and cooperated with a corresponding second contact to form a transmission path. A pair of latch devices is provided on each opposite end of the female portion and male potion for fastening each other.

Other objects, advantages and novel features of the invention will become more apparent from the following detailed description when taken in conjunction with the accompanying drawings.

DETAILED DESCRIPTION OF THE INVENTION

Figure 1:
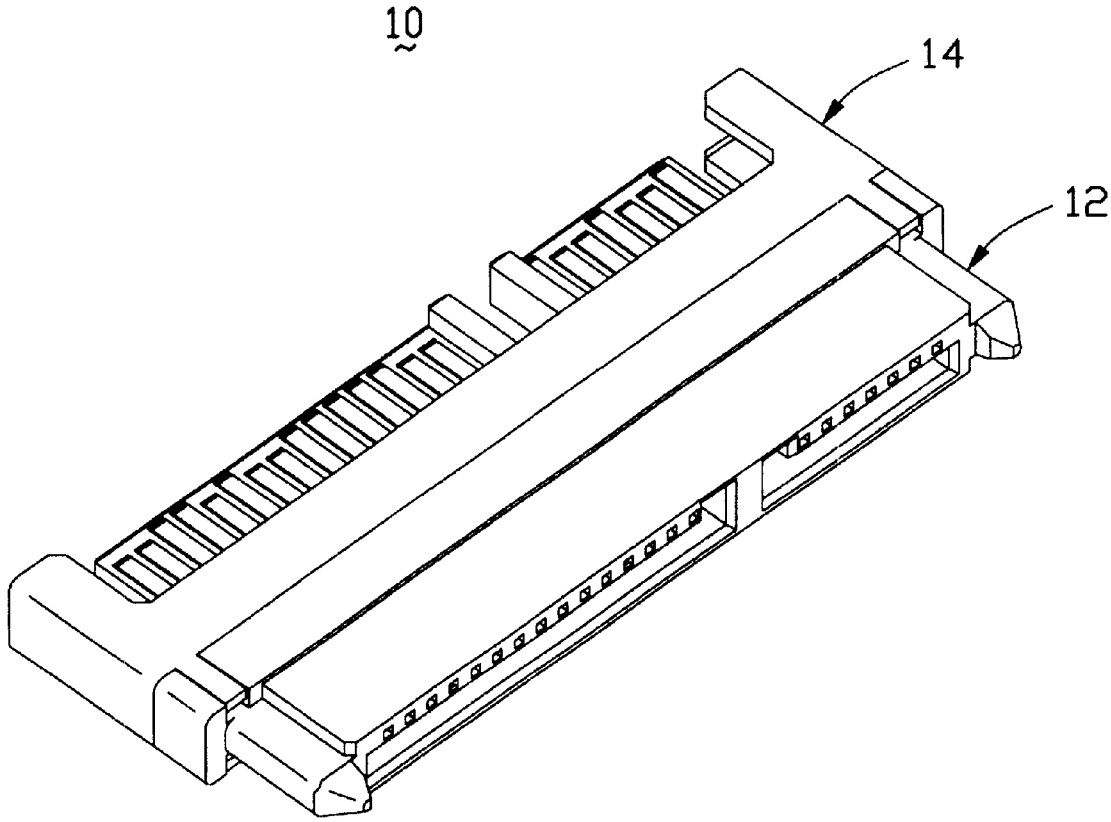
FIG. 1 is a perspective view of an electrical extender in accordance with the present invention.

Referring to FIGS. 1–5, an extender in accordance with the present invention, generally designated with reference numeral 10, comprises a female portion 12 and a male portion 14 for respectively mating with a female Serial ATA connector (not shown) mounted on a backplane and a male Serial ATA connector (not shown) connected with a hard disk.

Figure 2:
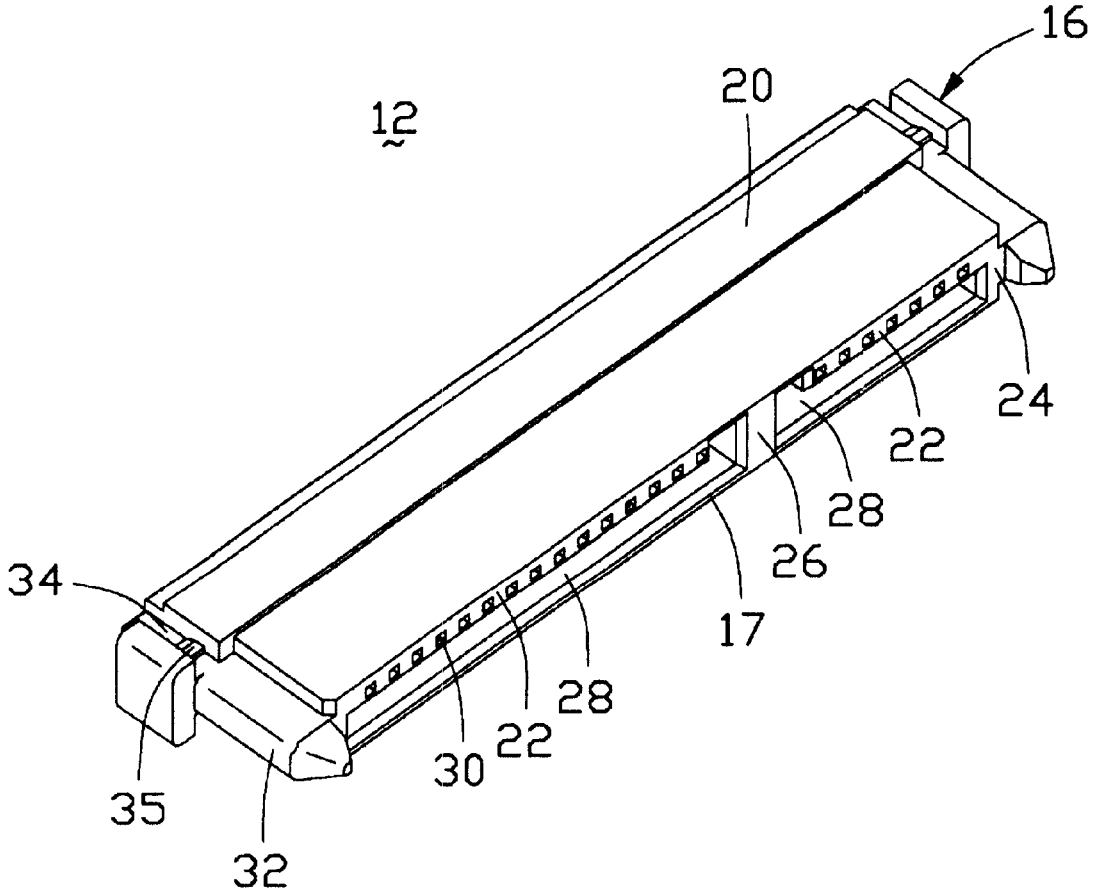
FIG. 2 is a front perspective view of a female portion of the extender of FIG. 1.
Figure 3:
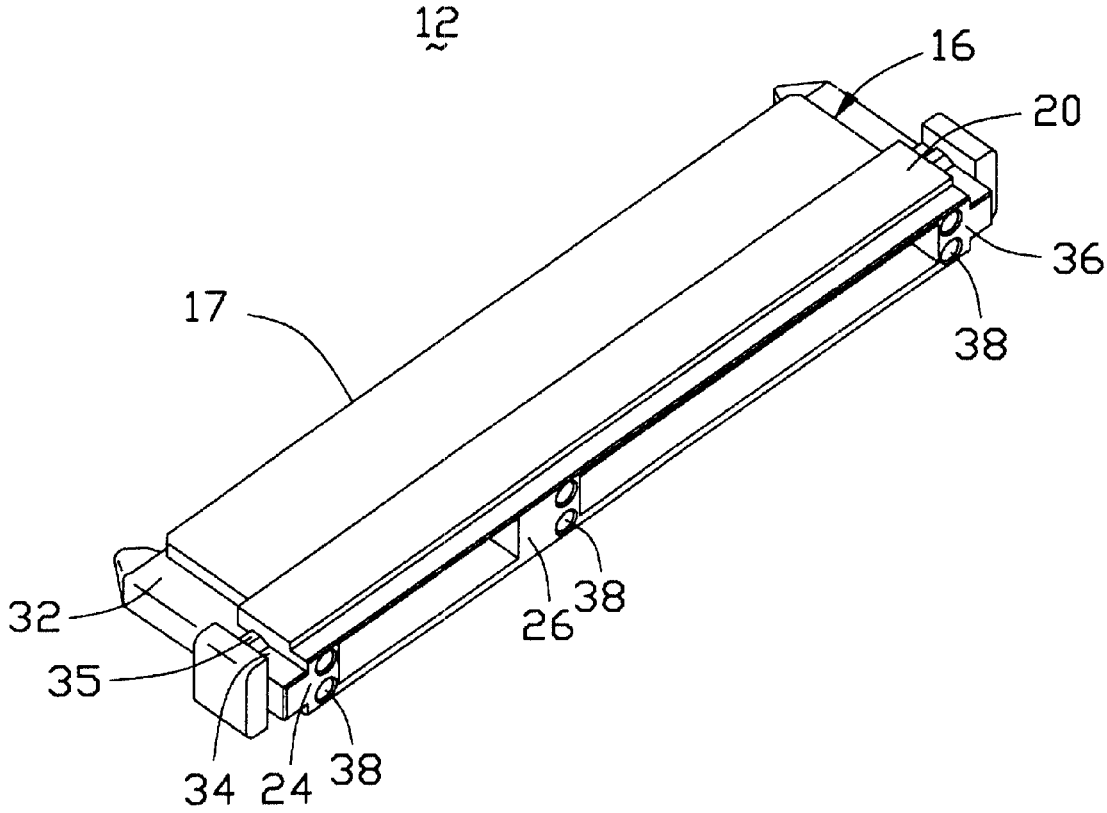
FIG. 3 is a back perspective view of the female portion section of the extender of FIG. 1.

The female portion 12, shown in FIGS. 2–3, includes a first elongated housing 16 having a first mating face 17 and a plurality of first contacts. The first contacts comprise first signal/power contacts 18 (FIG. 7 and FIG. 8) and first grounding contacts 19 (FIG. 9) wherein the front end of the first signal/power contact 18 is rearwardly offset from that of the first grounding contact 19 relative to the front/mating face 17. The first housing 16 has a first base 20, a pair of longitudinal side portions 22 extending from the first base 20, a pair of lateral ends 24, and an intermediate wall 26 extending parallelly between the lateral ends 24 and connecting with the longitudinal side portion 22. The longitudinal side portions 22, the lateral ends 24 and the intermediate wall 26 confine two slots 28. One slot 28 has a longitudinal dimension larger than that of the other slot 28. One of the longitudinal side portions 22 is longer than the other longitudinal side portion 22. Each longitudinal side portion 22 defines a plurality of first passageways 30. A corresponding number of openings 31 (shown in FIG. 7) communicate the passageways 30 with a corresponding slot 28. Note particularly that two openings 31 are located more adjacent to the first mating face 17 than the other openings 31.

Referring to FIGS. 2–3, a pair of alignment posts 32 is disposed adjacent to the lateral ends 24 of the housing 16. The first base 20 has two channels 34 defined at the opposite longitudinal ends of the first base 20, and a step portion 35 formed at the bottom of each channel 34. As best shown in FIG. 3, the first base 20 of the first housing 16 includes a first abutment surface 36 opposite to the first mating face 17. Each of the intermediate wall 26 and the lateral ends 24 defines a pair of polarization holes 38 in the first abutment surface 36 for receiving a pair of corresponding polarization posts 58 (FIG. 5) of the male portion 14 that will be described in detail later.

Figure 7:
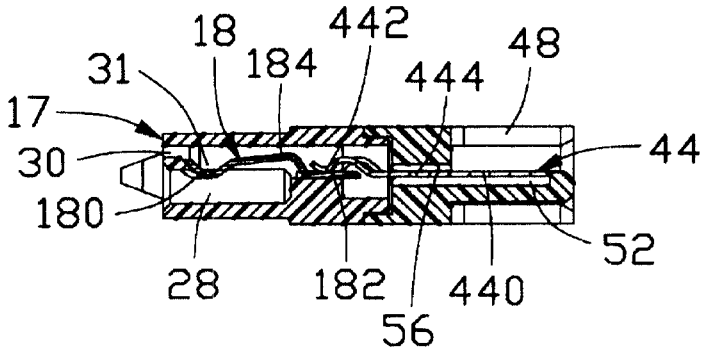
FIG. 7 is a cross-sectional view taken along line 7—7 of FIG. 6.
Figure 8:
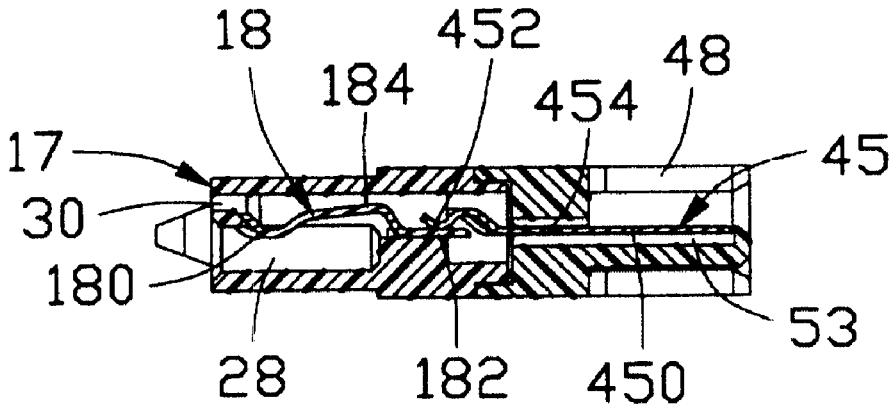
FIG. 8 is a cross-sectional view taken along 8—8 of FIG. 6.

Each first signal/power contact 18, shown in FIGS. 7–8, generally comprises a first contact portion 180, a first mounting portion 182, and a first connection portion 184 connecting the first contact portion 180 and the first mounting portion 182. The first signal/power contacts 18 are inserted into the first passageways 30 from the first abutment surface 36. The first contact portions 180 are partly exposed in the slots 28 through the openings 31. The first mounting portions 182 are accommodated into the first passageways 30 and engage with the first housing 16 reliably.

Figure 9:
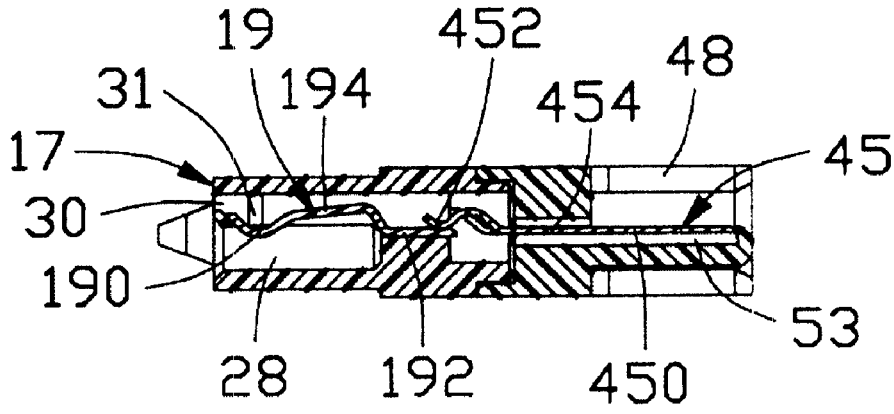
FIG. 9 is a cross-sectional view taken along line 9—9 of FIG. 6.

The first grounding contacts 19 have the same dimension and shape as the first signal/power contacts 18. The preferred embodiment comprises a pair of first grounding contacts 19. As best shown in FIG. 9, each first grounding contact 19 also comprises a first contact portion 190, a first mounting portion 192 and a first connection portion 194. The pair of first grounding contacts 19 is received in the pair of first passageways 30 which communicate with the two openings 31 more adjacent to the first mating face 17. In other words, a distance between the first contact portion 190 of each first grounding contact 19 and the mating face 17 is smaller than a distance between the first contact portion 182 of each first signal/power contact 18 and the mating face 17. Correspondingly, the first mounting portions 192 of the grounding contacts 19 are fixed with the first housing 16 in a position far away from the abutment surface 36 than the signal/power contacts 18.

Figure 4:
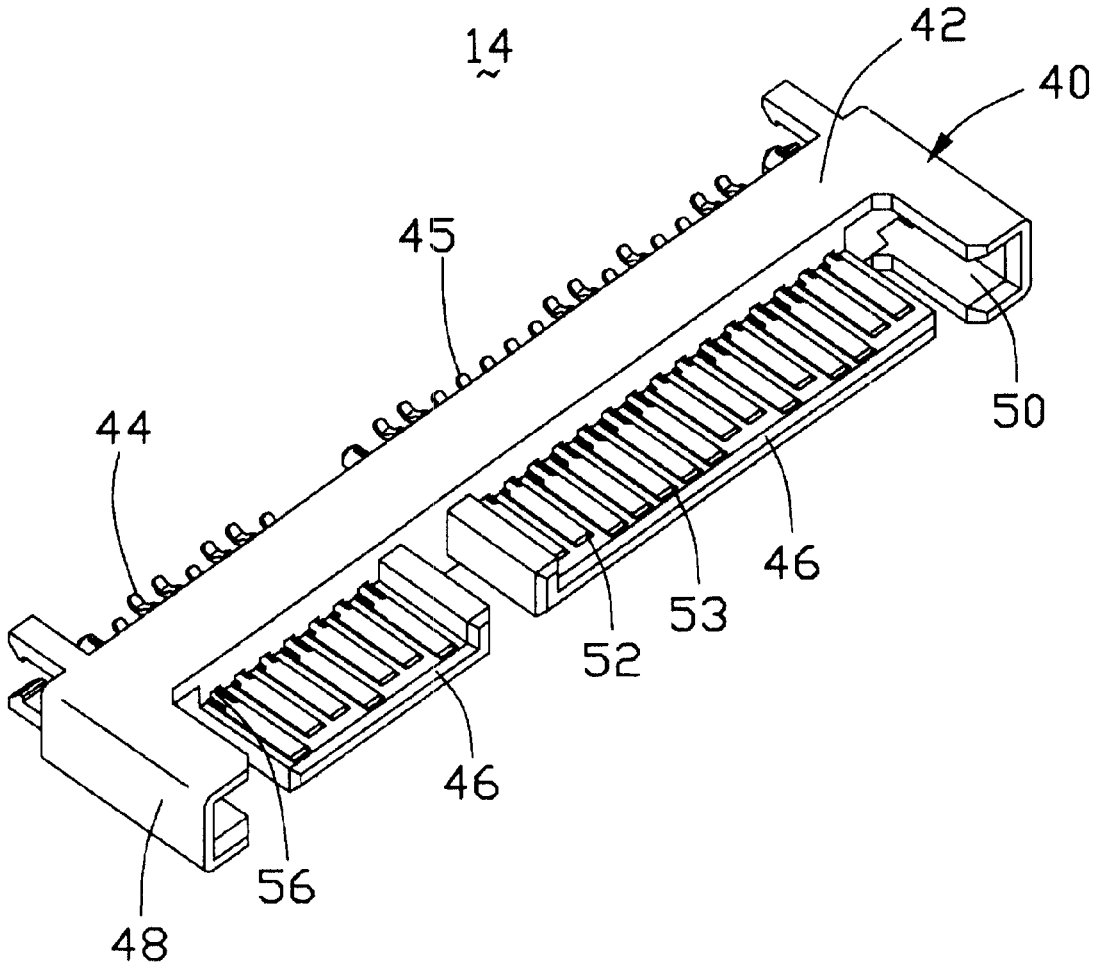
FIG. 4 is a front perspective view of a male portion of the extender of FIG 1.
Figure 5:
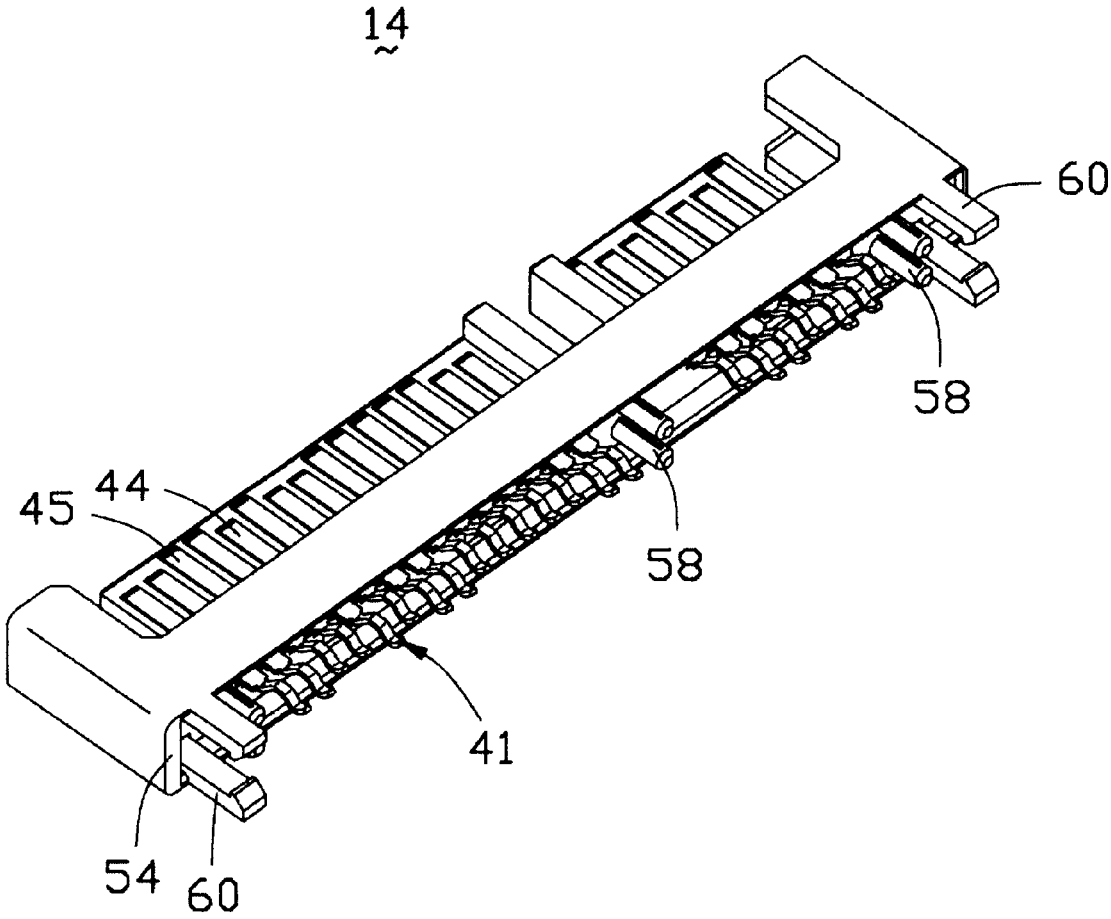
FIG. 5 is a back perspective view of the male portion of the extender of FIG 1.
Figure 6:
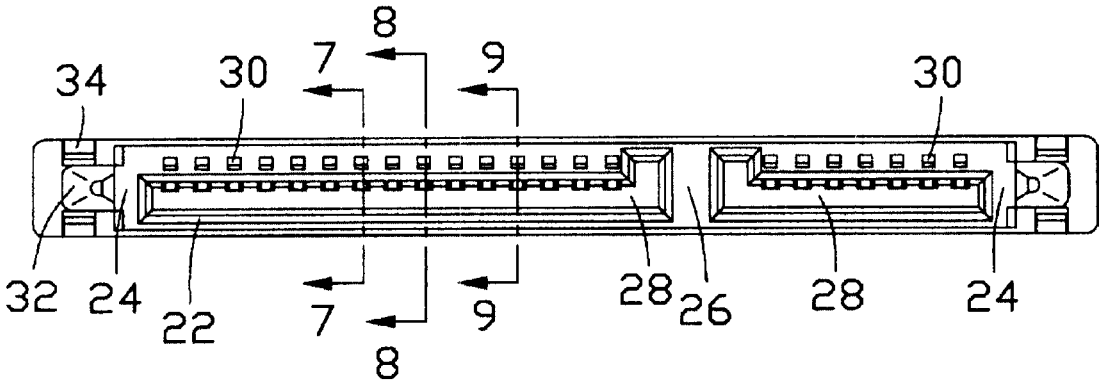
FIG. 6 is a front planar view of the extender of FIG. 1.

Referring particularly to FIGS. 4–5, the male portion 14 includes a second housing 40 having a second base 42, and a plurality of second contacts 41. A pair of tongues 46 of different longitudinal dimensions projects forwardly from the second base 42. A pair of lateral end portions 48 extends parallel to the tongues 46 and each defines a recess 50 facing the tongues 46. Each tongue 46 defines a plurality of shorter positioning slits 52 and a plurality of longer positioning slits 53 for retaining the second contacts 41.

A second abutment surface 54 is provided on the second base 42 of the male portion 14. A plurality of second passageways 56 extends through the base 42 and respectively communicates with the positioning slits 52. Three pairs of polarization posts 58 project beyond the second abutment surface 54 for respectively being received into the polarization holes 38 of the female portion 12. Two pairs of latches 60 extend rearwardly from the opposite longitudinal ends of the second base 42.

Similar to the first contacts, the second contacts 41 also comprise second signal contacts 44 and second power/grounding contacts 45 wherein the front end of the signal contact 44 is rearward offset from that of the power/grounding contact 45 relative to the front face of the tongue 46. Each second signal contact 44, as best shown in FIG. 7, includes a second contact portion 440, a free end 442, and a second mounting portion 444 connecting the second contact portion 440 and the free end 442. The second contact portion 440 is received into the shorter positioning slit 52. The second mounting portion 444 is accommodated into the passageway 56 and fixes with the second housing 40. The free end 442 is rearwardly exposed.

The second power/grounding contacts 45 have the same dimension and shape as the second signal contacts 44. As shown in FIGS. 8–9, each second power/grounding contact 45 also comprises a second contact portion 450, a free end 452 and a second mounting portion 454. The second contact portion 450 of the grounding/power contact 45 is positioned into a corresponding longer positioning slit 53 and adjacent to a free end (not labeled) of the tongue 46. Correspondingly, the length of the free ends 452 of the second grounding/power contacts 45 projecting from the second abutment surface 54 is smaller than that of the free ends 442 of the signal contacts 44.

It should be noted that each first passageway 30 of the first housing 16 is substantially aligned with a corresponding second passageway 56 of the second housing 40 along their length direction. Therefore, the exposed free end 442 (452) of the second contact 41 is aligned with the mounting portion 182 (192) of a corresponding first contact retained in the first passageway 30.

When assembled, referring to FIG. 1 in conjunction with FIGS. 2 and 5, the second abutment surface 54 of the male portion 14 confronts the first abutment surface 36 of the female portion 12. The latches 60 of the male portion 14 are retained in the channels 34 and engage with the step portions 35 of the female portion 12. The polarization posts 58 of the male portion 14 are snugly received within the corresponding polarization holes 38 of the female portion 12 for avoiding reverse assembling along the lengthwise direction of the first housing 16 and the second housing 40. The male portion 14 and the female portion 12 are thus fastened with each other.

It is noted that when the male portion 14 and the female portion 12 are combined together, the free ends 442 (452) of the second contacts 41, which originally project out from the second abutment surface 54, may properly be mated with the corresponding first mounting portions 182 (192) of the first contacts, as shown in FIGS. 7–9.

It is also noted that, as best shown in FIGS. 8–9, because two openings 31 of the female portion 12 which receive the first grounding contacts 19 are more adjacent to the first mating face 17 than the other openings 31, correspondingly, the first contact portions 190 of the first grounding contacts 19 exposed in the slots 28 are more adjacent to the first mating face 17 than the first contact portions 180 of the signal/power contacts 18. On the other hand, the positioning slits 53 receiving the second grounding/power contacts 45 are longer than the positioning slits 52 receiving the second signal contacts 44. The second contact portions 450 of the second grounding/power contacts 45 are more adjacent to the free ends (not labeled) of the tongues 46 of the male portion 14 than the second contact portions 440 of the second signal contacts 44. Therefore, when the extender 10 is applied, a grounding path is first established between the backplane and the hard disk, and then are the power path, and signal transmission path.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, similar to the aforementioned 6,071,150, the first contact can be integrally formed with the corresponding aligned second contact for decreasing the part numbers.

What is claimed is:

1. An extender for interconnecting a male connector and a female connector, comprising:

a female portion comprising a first housing and a plurality of first contacts, the first housing having a first mating face, a first abutment surface opposite to the first mating face, and two slots defined in the first mating face, the first contacts being partially exposed to the slots and having first mounting portions fixed with the first housing; and a male portion comprising a second housing and a plurality of second contacts, the second housing having a base having a second abutment surface and a pair of tongues projecting forwardly from the base, the tongues defining a plurality of positioning slits, each second contact having a contact portion retained in a corresponding positioning slit and a free end projecting outwardly beyond the second abutment surface; wherein the female portion and the male portion are fastened with each other in a back-to-back manner, the first abutment surface of the first housing confronts the second abutment surface of the second housing, and the free ends of the second contacts mate with the first mounting portions of the first contacts; wherein the first housing defines two channels at opposite ends thereof and a step portion formed at the bottom of each channel, and the second housing comprises two pairs of latches for being received in the channels and engaging with the corresponding step portions of the first housing; wherein the first housing of the female portion comprises a pair of longitudinal side portions facing the slots, one longitudinal side portion being longer than the other, wherein each longitudinal side portion defines a plurality of openings communicating a corresponding slot.

2. The extender as claimed in claim 1, wherein the first housing defines a plurality of polarization holes in the first abutment surface, and the second housing comprises a corresponding number of polarization posts projecting beyond the second abutment surface and received within the corresponding polarization holes.

3. The extender as claimed in claim 1 wherein one opening is located more adjacent to the first mating face of the first housing than the other openings.

4. The extender as claimed in claim 3, wherein each first contact of the female portion comprises a first contact portion and a first connection portion connecting wit the first mounting portion, the first contact portion being exposed to a corresponding slot.

5. The extender as claimed in claim 4, wherein the first contacts of the female portion comprise one grounding contact which has a first contact portion exposed to said one opening, a distance between the contact portion of said one grounding contact and the first mating face being smaller than a distance between the contact portions of the other first contacts and the first mating face.

6. The extender as claimed in claim 1, wherein one tongue of the male portion is longer than the other.

7. The extender as claimed in claim 1, wherein one positioning slit has a longer dimension than the other positioning slits, the longer positioning slit being more adjacent to a free end of the tongue than the other positioning slits.

8. The extender as claimed in claim 7, wherein the second contacts of the male portion comprise a second grounding/power contact which has a second contact portion received in the longer positioning slit, the length of the free end of the second grounding/power contact projecting beyond the second abutment surface being smaller than the free ends of the other second contacts.

9. An extender for interconnecting a male connector and a female connector, comprising:

a female portion comprising a first housing and a plurality of first contacts received in the first housing, the first housing having a first abutment surface and a plurality of polarization holes defined in the first abutment surface, the first contacts having first mounting portions fixed with the first housing; and a male portion comprising a second housing and a plurality of second contacts received in the second housing, the second housing having a second abutment surface and a plurality of polarization posts projecting beyond the second abutment surface, each second contact having a free end projecting outwardly beyond the second abutment surface; wherein the female portion and the male portion are fastened with each other in a back-to-back manner, the first abutment surface of the first housing confronts the second abutment surface of the second housing, the polarization posts are snugly received within the corresponding polarization holes, and the free ends of the second contacts mate with the first mounting portions of the first contacts; wherein the first housing of the female portion comprise a pair of longitudinal side portions facing the slots, one longitudinal side portion being longer than the other; wherein the first housing defines two channels at opposite ends thereof and a step portion formed at the bottom of each channel, and the second housing comprises two pairs of latches for being received in the channels and engaging with the corresponding step portions of the first housing.

* * * * *